US010513752B2

(12) United States Patent
Gordon et al.

(10) Patent No.: US 10,513,752 B2
(45) Date of Patent: Dec. 24, 2019

(54) INTERSEPARATION OF METALS

(71) Applicants: Johnson Matthey Public Limited Company, London (GB); Anglo American Platinum Limited, Johannesburg (ZA)

(72) Inventors: Ross John Gordon, Reading (GB); Richard Alasdair Grant, Reading (GB)

(73) Assignee: Johnson Matthey Public Limited Company, London, England (GB)

( * ) Notice: Subject to any disclaimer, the term of this patent is extended or adjusted under 35 U.S.C. 154(b) by 418 days.

(21) Appl. No.: 15/318,816

(22) PCT Filed: Jun. 16, 2015

(86) PCT No.: PCT/GB2015/051762
§ 371 (c)(1),
(2) Date: Dec. 14, 2016

(87) PCT Pub. No.: WO2015/193656
PCT Pub. Date: Dec. 23, 2015

(65) Prior Publication Data

US 2017/0137913 A1 May 18, 2017

(30) Foreign Application Priority Data

Jun. 18, 2014 (GB) ..... 1410883.1

(51) Int. Cl.
*C22B 11/00* (2006.01)
*C22B 3/00* (2006.01)
*C22B 7/00* (2006.01)

(52) U.S. Cl.
CPC ..... *C22B 11/04* (2013.01); *C22B 7/006* (2013.01); *C22B 11/00* (2013.01)

(58) Field of Classification Search
None
See application file for complete search history.

(56) References Cited

U.S. PATENT DOCUMENTS 4,041,126 A 8/1977 Baltz et al.
4,654,145 A 3/1987 Demopoulos et al.
(Continued)

FOREIGN PATENT DOCUMENTS

CN 102002589 A 4/2011
CN 10241798 A 4/2012
(Continued)

OTHER PUBLICATIONS

Cleare, M.J., et al, "Separation of the platinum group metals by use of selective solvent extraction techniques," Extraction Metallurgy 1981 : Papers presented at the symposium organised by the Institution of Mining and Metallurgy . . . and held in London from Sep. 21 to 23, 1981, Jan. 1, 1981, pp. 34-41.
(Continued)

*Primary Examiner* — Anita Nassiri-Motlagh
(74) *Attorney, Agent, or Firm* — BakerHostetler

(57) ABSTRACT

The invention relates to processes for separating metals, and in particular for separating precious metals such as platinum and palladium, by solvent extraction. The invention also provides novel solvent extraction mixtures useful in the processes of the invention. The inventors have found that by simultaneously employing different extraction mechanisms for the extraction of a plurality of different metals, a simple and convenient process for their separation can be achieved. In particular, the inventors have found that the use of different extraction mechanisms for simultaneously extracting metals from an aqueous acidic phase into an organic phase enables the extracted metals to be separated by selective stripping from the organic phase using simple and mild conditions. This process is particularly advantageous as
(Continued)

it permits two or more metals to be separated following a single solvent extraction step, because of the ability to selectively strip the metals from the organic phase.

16 Claims, 3 Drawing Sheets

(56) References Cited

U.S. PATENT DOCUMENTS

| | | | |
|---|---|---|---|
| 4,935,550 | A | 6/1990 | Miller et al. |
| 5,045,290 | A | 3/1991 | Harris et al. |
| 5,196,095 | A | 3/1993 | Sudderth et al. |
| 7,157,003 | B2 | 1/2007 | Baron et al. |
| 2009/0178513 | A1 | 7/2009 | Narita et al. |
| 2010/0095807 | A1 | 4/2010 | Narita et al. |

FOREIGN PATENT DOCUMENTS

| | | | |
|---|---|---|---|
| EP | 0301783 | A2 | 2/1989 |
| EP | 0210004 | B1 | 5/1990 |
| EP | 0756013 | A1 | 1/1997 |
| GB | 1495931 | | 12/1977 |
| JP | H09203792 | A | 8/1997 |
| JP | 2001098335 | A | 4/2001 |
| JP | 2004-183093 | A | 7/2007 |
| RU | 2103394 | C1 | 1/1998 |
| RU | 96104848 | A | 2/1998 |
| WO | 9316204 | | 8/1993 |
| WO | WO 99/14385 | A1 | 3/1999 |
| WO | 2013026885 | A1 | 2/2013 |

OTHER PUBLICATIONS

Edtmaier, C., et al, "Process parameters, Reaction Kinetics and PGM Flow during Solvent Extraction of Palladium with Di-Alkyl-Sulfides," Precious Metals, Pergamon, New York, NY, US, vol. 23, Jan. 1, 1999, pp. 231-239.

Fritsch, E., et al, "Untersuchungen zur Extraktion von Edelmetallen mit Thioethern," ("Studies on the extraction of noble metals using thio ethers"), ZFI-Mitteilungen, Leipzig, DE, vol. 67, Jan. 1, 1983, pp. 5-41.

Guobang, Gu et al, "Semi-industrial Test on Co-extraction Separation of Pt and Pd by Petroleum Sulfoxides," Solvent Extraction in the Process Industries vol. 1, Proceedings of ISEC 1993.

Ma, E., et al, "Solvent Extraction of Au(III), Pd(II) and Pt (IV) With Sulfur-Containing Methylphosphonates and Beta-Ketophosphonate," Solvent Extraction and Ion Exchange; 1988, 6(6), pp. 1035-1047.

Men'Shikov, V.I., et al, "Preconcentration of Gold, Silver, Palladium, Platinum, and Rutheniu with Organophosphorus Extractants," Russian Journal of Applied Chemistry, 2009 (82)2, pp. 183-189.

Grant, R.A., "The Separation Chemistry of Rhodium and Iridium," Precious Metals Recovery and Refining—Proceedings of a Seminar of the International Precious Metal Institute, Scottsdale, Arizona held Nov. 12-14, 1989, pp. 7-39.

INTERSEPARATION OF METALS

TECHNICAL FIELD

The present invention relates to processes for separating metals, and in particular for separating precious metals such as platinum and palladium, by solvent extraction. The present invention also provides novel solvent extraction mixtures useful in the processes of the present invention.

BACKGROUND

Solvent extraction is an important part of many processes for the recovery of precious metals from their ores (e.g. ore concentrates) or from scrap material. Solvent extraction can be employed to separate precious metals from base metals and other substances, and from each other, in order that relatively pure metal samples may be recovered.

In order to achieve this, typically an aqueous acidified solution comprising species of two or more different precious metals, optionally in combination with base metals, is contacted with an organic phase comprising an extractant. Typically, the extractant is selective for one or more of the precious metals to be separated, thus facilitating their separation by selectively extracting them from the aqueous phase into the organic phase. Further processing steps enable recovery of the separated metal.

For example, GB 1 495 931 describes organic solvent extraction of platinum and iridium species from an aqueous acidic solution also containing rhodium species by using a solvent containing a tertiary amine extractant. However, this separation does not achieve separation of the metals in the presence of palladium species, and so has the disadvantage of requiring palladium species to be removed before platinum may be liberated.

EP 0 210 004 describes an extractant which is suitable for extracting platinum from an acidified aqueous solution which also includes palladium. The extractant is a mono-N-substituted amide. This extractant also permits separation of platinum species from other precious metals which may be present in the solution, particularly where ruthenium, iridium and osmium species are present in oxidation state III, while the platinum species is in oxidation state IV. EP 0 210 004 explains that this may be achieved by treating the aqueous phase with a mild reducing agent. Following treatment with the mono-N-substituted amide, further treatment of the aqueous phase is required if the palladium is to be recovered.

Palladium may be extracted into an organic phase using thioether extractants. For example, as explained in US2009/0178513, DHS (di-n-hexylsulfide) is one of the most commonly used industrial extractants for palladium, which is capable of selectively extracting palladium from an acidic aqueous solution containing palladium, platinum and rhodium. US2009/0178513 proposes a different thioether-containing extractant having the following formula:

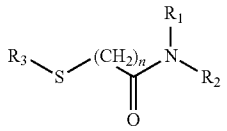

where $R_1$, $R_2$ and $R_3$ each represents a group selected from a chain hydrocarbon group having 1 to 18 carbon atoms. US2009/0178513 states that the extractant described therein enables the extraction of palladium to be performed more rapidly than is possible using DHS, but that the other platinum group metals (including platinum) are hardly extracted at all. The palladium in the organic solution is recovered using ammonia.

As an alternative to selective extraction, some documents propose simultaneously extracting more than one metal into the organic phase, followed by selectively removing each metal from the organic phase. For example, U.S. Pat. No. 4,654,145 describes co-extraction of precious metals including gold, platinum and palladium into an organic phase using Kelex® 100:

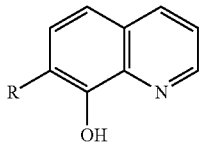

The gold is then precipitated out of the solution, followed by precipitation of the palladium. Platinum is removed from the organic phase by washing with an aqueous phase. However, the processes proposed in this document suffer the disadvantage of including precipitation to separate the metals extracted into the organic phase.

U.S. Pat. No. 5,045,290 describes a process for the recovery of Pt and Pd from an impure substantially gold-free precious and base metal-bearing acidic chloride or mixed chloride/sulphate solution, comprising the steps of contacting the acidic solution having a pH of less than about 1.5 with an organic solution comprising an 8-hydroxyquinoline solvent extraction reagent, a phase modifier and an aromatic diluent to extract simultaneously platinum and palladium into the organic solution, scrubbing the co-extracted solution to remove co-extracted impurities and acid, stripping the loaded organic with a buffer solution operating in the pH range 2-5 at 20-50° C. to selectively recover the platinum, stripping the platinum-free loaded organic with 3-8 M hydrochloric acid to recover the palladium, and regenerating the organic solution by washing with water.

Guobang et al. (Reference 1) describes co-extraction of Pt and Pd using petroleum sulfoxides. After washing, Pt is removed from the organic phase using dilute HCl and Pd is removed using aqueous $NH_3$.

US2010/0095807 describes a separation reagent for separating platinum group metals from an acidic solution containing rhodium, platinum and palladium. The reagent has the general formula:

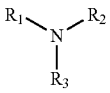

wherein at least one of $R_1$, $R_2$ and $R_3$ represent an amide group represented by:

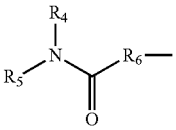

wherein each of $R_1$ to $R_3$ other than the amide group, and $R_4$ to $R_6$ are hydrocarbon groups. In the separation methods described in this document, rhodium, platinum, and palladium are co-extracted using the extractant reagent. Highly concentrated hydrochloric acid solution is then used to recover rhodium from the organic phase. The platinum and palladium are then back-extracted from the organic phase using highly concentrated nitric acid solution, to produce an aqueous solution including both platinum and palladium.

U.S. Pat. No. 4,041,126 describes co-extraction of platinum and palladium from acidic aqueous medium using an organically substituted secondary amine capable of forming complexes of platinum and palladium. Palladium is selectively recovered from the organic phase with an aqueous solution of an acidified reducing agent. Platinum is separately recovered using an alkaline stripping reagent selected from alkali metal and alkaline earth metal carbonates, bicarbonates and hydroxides.

SUMMARY OF THE INVENTION

There remains a need for improved processes for the separation of metals, particularly those which enable the separation of precious metals, such as platinum and palladium.

The present inventors have found that by simultaneously employing different extraction mechanisms for the extraction of a plurality of different metals, a simple and convenient process for their separation can be achieved. In particular, the present inventors have found that the use of different extraction mechanisms for simultaneously extracting metals from an aqueous acidic phase into an organic phase enables the extracted metals to be separated by selective stripping from the organic phase using simple and mild conditions. This process is particularly advantageous as it permits two or more metals to be separated following a single solvent extraction step, because of the ability to selectively strip the metals from the organic phase. In current industrial processes, a separate extraction step and a separate stripping step is typically required for each metal, or metals are co-extracted and subsequently separated by selective precipitation.

In acidified aqueous solutions, metals typically exist as complexes, having ligands coordinated to a central metal atom. For example, in an aqueous HCl solution, platinum may exist as a $[PtCl_6]^{2-}$ complex ion species, where six $Cl^-$ or ligands are coordinated to a central Pt atom in oxidation state (IV). Similarly, palladium and other metals typically exist as neutral complexes or charged complexes. For example, Pd typically exists as $[PdCl_4]^{2-}$.

Extractants for solvent extraction are typically soluble in the organic phase but predominantly insoluble in the aqueous phase from which the metal species are extracted. Their interaction with metal species increases the solubility of the metal species in the organic phase and decreases its solubility in the aqueous phase, with the effect that the metal species are transferred to the organic phase.

In order to effect extraction of the metal from the aqueous phase into an organic phase, extractants typically interact with the metal species in one of two ways: by coordination with the metal atom itself (inner sphere interaction), or by interacting with the whole complex or complex ion in an outer sphere interaction (e.g. solvating and/or ion pair interaction). Accordingly, extractants can be categorised as outer sphere (e.g. solvating) extractants or coordinating (or inner sphere) extractants, based on the way in which they typically interact with the metal species during extraction. The behaviour of extractants in extraction of precious metals from acidified solutions is discussed in Reference 2, which is hereby incorporated by reference in its entirety and particularly for the purposes of describing and defining the behaviour of extractants in metal extraction from acidified solutions.

Species of different metals typically interact more readily with one type of extractant than another. The present inventors have found that two different metals can be extracted simultaneously into an organic phase using a combination of an outer sphere extractant and a coordinating extractant. In the organic phase, each of the extracted metal species remains associated predominantly with either coordinating extractant molecules or outer sphere extractant molecules. The present inventors have found that this difference in the way the two metal species interact with their extractants can be exploited to enable selective stripping of the metal species from the organic phase into aqueous phases in order to separate the metals.

The way in which a metal species interacts with organic extractants is affected primarily by how labile the metal ion is. In other words, this depends on how readily the ligands coordinating with the central metal atom of the metal species are displaced by coordinating extractant molecules. Where the ligands are readily displaced by a coordinating extractant molecule, the metal will typically interact predominantly with the coordinating extractant. In contrast, where ligands are not readily displaced, the metal species will typically interact predominantly with the outer sphere extractant. This is a kinetic effect.

For example, palladium species in aqueous acidified solutions typically interact predominantly with coordinating extractants, and platinum species typically interact predominantly with outer sphere extractants. Accordingly, the present inventors have found that platinum and palladium species may be simultaneously extracted from an acidified aqueous phase using a combination of a coordinating extractant and an outer sphere extractant, and then selectively stripped from the organic phase using simple, mild techniques to produce two aqueous solutions—one comprising platinum species and one comprising palladium species. For example, the platinum may be stripped using water or a weakly acidic aqueous solution. Palladium may be stripped using a complexing reagent such as aqueous ammonia.

As the skilled person will understand, the present inventors' realisation that a combination of complexing and outer sphere extractants may be employed to separate metals by a process involving co-extraction and selective stripping is applicable not only to platinum and palladium, but also to other pairs of labile and non-labile metal species.

Accordingly, in a first preferred aspect, the present invention provides a method of separating labile metal species and non-labile metal species present in an aqueous acidic phase, comprising (a) contacting the aqueous acidic phase with an organic phase comprising:
  (i) an outer sphere extractant capable of extracting the non-labile metal species into the organic phase; and
  (ii) a coordinating extractant capable of coordinating with the labile metal atom of the labile metal species,
  whereby the labile and non-labile metals are extracted into the organic phase, then
(b) selectively stripping the metals from the organic phase by
  contacting the organic phase with water or an acidic aqueous solution to provide a first aqueous solution comprising non-labile metal species, and contacting the organic phase with an aqueous phase comprising a complexing reagent capable of complexing with the labile metal atom of the labile metal species to provide a second aqueous solution comprising labile metal species.

Preferably the labile metal species is a palladium species. Preferably the non-labile metal species is a platinum species. Accordingly, in a more preferred aspect the present invention provides a method of separating platinum species and palladium species present in an aqueous acidic phase, comprising (a) contacting the aqueous acidic phase with an organic phase comprising:
  (i) an outer sphere extractant capable of extracting the platinum species into the organic phase; and
  (ii) a coordinating extractant capable of coordinating with the palladium atom of the palladium species, whereby the platinum and palladium are extracted into the organic phase, then (b) selectively stripping the platinum and palladium from the organic phase by
  contacting the organic phase with water or an acidic aqueous solution to provide a first aqueous solution comprising platinum species, and
  contacting the organic phase with an aqueous phase comprising a complexing reagent capable of complexing with the palladium to provide a second aqueous solution comprising palladium species.

In a second preferred aspect, the present invention provides a solvent extraction mixture comprising a diluent, an outer sphere extractant and a coordinating extractant.

In a third preferred aspect, the present invention provides use of a solvent extraction mixture according to the second preferred aspect for the separation of labile metal species from non-labile metal species.

In a fourth preferred aspect, the present invention provides a process for the preparation of a solvent extraction mixture (e.g. according to the second preferred aspect) comprising combining a diluent, an outer sphere extractant and a coordinating extractant.

DETAILED DESCRIPTION

Figure 1:
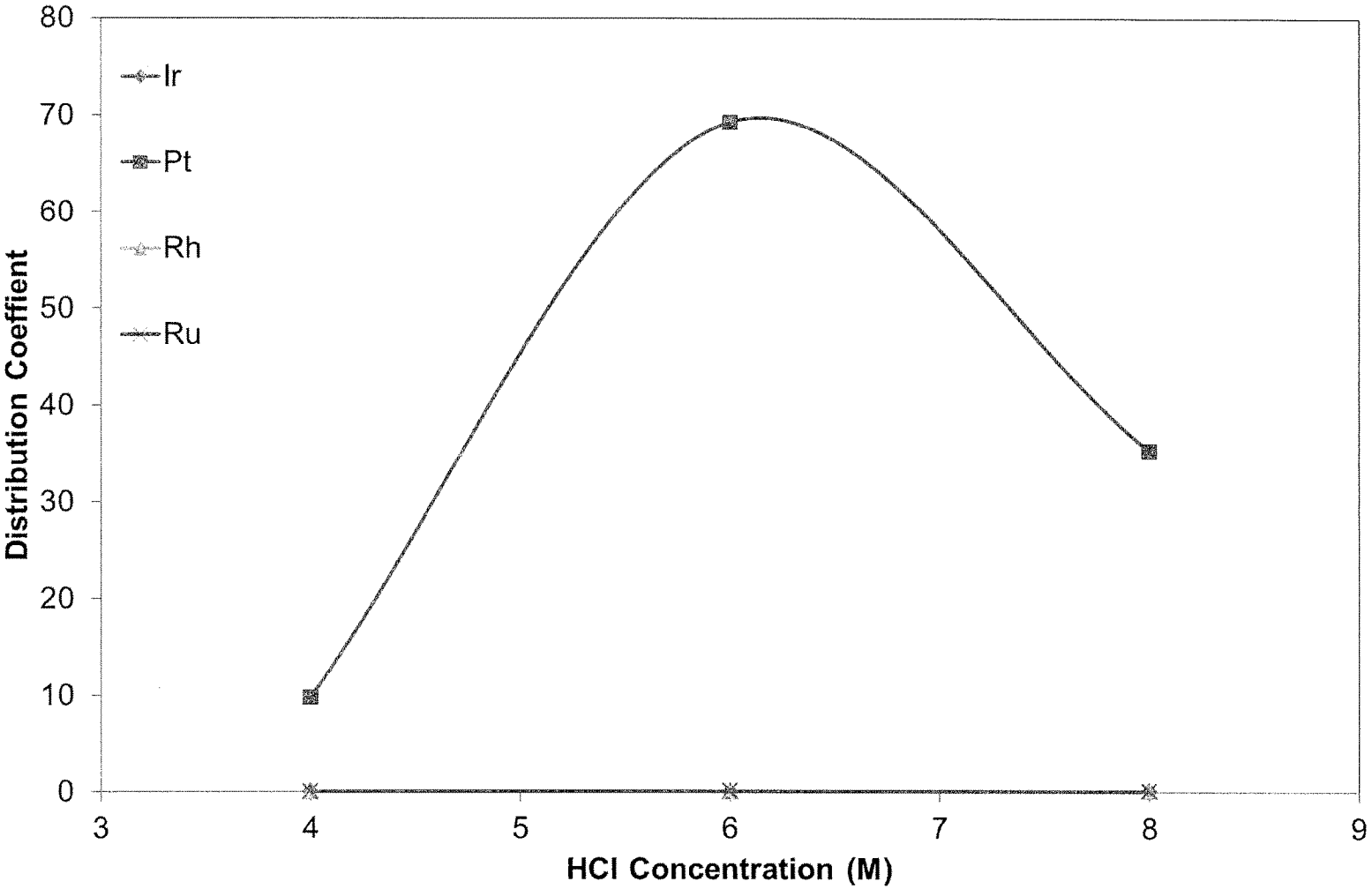
FIG. 1 shows the distribution coefficients for Pt, Ir, Rh and Ru at different feed acidities as determined in Example 1.

Preferred and/or optional features of the invention will now be set out. Any aspect of the invention may be combined with any other aspect of the invention, unless the context demands otherwise. Any of the preferred or optional features of any aspect may be combined, singly or in combination, with any aspect of the invention, unless the context demands otherwise.

The skilled person readily understands the terms labile and non-labile as they refer to metal species in acidic aqueous solutions, which are typically coordination complexes having a central metal atom. (As the skilled person will understand, a coordination complex may include more than one metal atom, each having one or more ligands coordinated thereto.) Typically, a labile metal species will readily undergo ligand exchange in an acidic aqueous solution. The result is that a covalent coordination bond may readily be formed between an extractant and the central metal atom of the labile metal species. For example, the coordinating extractant may displace another ligand from the coordination sphere of the labile metal species. Examples of metals which typically form labile metal species in acidic aqueous solutions are Pd (especially in the II oxidation state) and Au (especially in the III oxidation state).

Conversely, a non-labile metal species typically does not readily undergo ligand exchange in an aqueous acidic solution. The result is that covalent coordination bonds between an extractant and the central metal ion of the non-labile metal species do not readily form. Instead, the ligands of the coordination sphere of the labile metal species remain substantially unchanged during extraction. The extractant interacts with the entire non-labile metal species (i.e. the central metal atom and its associated ligands) by an outer sphere mechanism, typically involving non-covalent bonding interactions such as selected from one or more of electrostatic interactions, hydrogen bonding, dipole-dipole interactions, Van der Waals interactions, ion-ion interactions, ion-dipole interactions, solvation interactions, London interactions, and dipole-induced dipole interactions, but not including covalent bonding. Examples of metals which typically form non-labile metal species in acidic aqueous solutions are Pt (especially in the IV oxidation state), Ir (especially in the IV oxidation state), Os (especially in the IV oxidation state), and Ru (especially in the IV oxidation state).

Reference 2 describes the lability of precious metal ions in acidified solutions. In particular, FIG. 5 illustrates the differing substitution (ligand exchange) kinetics of chloro complexes of precious metals, relative to Pd(II). This Figure is reproduced below:

| Ruthenium | | Rhodium | | Palladium | | Silver | |
|---|---|---|---|---|---|---|---|
| Ru(III) | $10^{-3}$-$10^{-4}$ | Rh(III) | $10^{-3}$-$10^{-4}$ | Pd(II) | 1 | Ag(I) | $10^{-4}$-$10^{-6}$ |
| Ru(IV) | $10^{-5}$-$10^{-6}$ | | | | | | |

| Osmium | | Iridium | | Platinum | | Gold | |
|---|---|---|---|---|---|---|---|
| Os(III) | $10^{-7}$-$10^{-9}$ | Ir(III) | $10^{-4}$-$10^{-6}$ | Pt(II) | $10^{-3}$-$10^{-5}$ | Au(III) | $10^{1}$-$10^{-1}$ |
| Os(IV) | $10^{-10}$-$10^{-12}$ | Ir(IV) | $10^{-8}$-$10^{-10}$ | Pt(IV) | $10^{-10}$-$10^{-12}$ | | |

Pd(II) and Au(III), for example, can be considered to be labile, as their relative substitution kinetics are fast. Os(III), Os(IV), Ir(IV), Ru (IV) and Pt(IV), for example, can be considered to be non-labile, as their relative substitution kinetics are slow. Reference 2 is hereby incorporated by reference in its entirety and particularly for the purposes of describing the ligand substitution kinetics of precious metal chloro complexes and the lability of precious metals. Note that Os(III) is typically unstable in the presence of air.

In the present invention, a labile metal species may typically be defined as a metal species which is readily extracted from an aqueous acidic phase having an HCl concentration of 6 mol $dm^{-3}$ into an organic phase consisting essentially of di-n-octyl sulphide in an aromatic petroleum solvent. "Readily extracted" may typically mean that at least 95 mol % of the metal of the labile metal species is extracted into the organic phase in 60 minutes when an excess of di-n-octyl sulphide is provided. In the present invention, a non-labile metal species may typically be defined as a metal species which is not readily extracted from an aqueous acidic phase having an HCl concentration of 6 mol $dm^{-3}$ into an organic phase consisting essentially of di-n-octyl sulphide in an aromatic petroleum solvent. "Not readily extracted" may typically mean that less than 5 mol % of the metal of the labile metal species is extracted into the organic phase in 60 minutes when an excess of di-n-octyl sulphide is provided.

As the skilled person will understand, the term coordinating extractant includes extractants which are capable of forming a covalent coordination bond with the metal atom of the labile metal species. Typically, the coordinating extractant does not substantially interact with the non-labile metal species.

As the skilled person will understand, the term outer sphere extractant includes extractants which interact with a metal species to effect its extraction without forming a covalent coordination bond with the metal atom of the metal species. Typically, this interaction involves bonding interactions selected from one or more of electrostatic interactions (e.g. ion pairing), hydrogen bonding, dipole-dipole interactions, Van der Waals interactions, ion-ion interactions, ion-dipole interactions, solvation interactions, London interactions, and dipole-induced dipole interactions, but not including covalent bonding.

The outer sphere extractant may be capable of extracting the labile metal species (as well as the non-labile metal species), but this is not essential. If the outer sphere extractant is capable of extracting the labile metal species, the present inventors consider that this may provide an additional advantage. Typically, outer sphere interactions occur faster than coordinating interactions. The present inventors have found that where an outer sphere extractant is included, the rate of transfer of the labile metal species into the organic phase may be increased. Without wishing to be bound by theory, this is believed to be because the labile metal species initially interacts with the outer sphere extractant, effecting its transfer into the organic phase much faster than would be expected using a coordinating extractant. Once in the organic phase, it is believed to form a complex with the coordinating extractant. This reaction happens more slowly, but the present inventors believe that it is this interaction with the coordinating extractant which retains the labile metal species in the organic phase, and enables the advantageous selective stripping described herein. Of course, some of the labile metal species may also interact with the coordinating extractant in the aqueous acidic phase and be extracted by a more conventional coordination extraction process.

Metals to be Separated

The present invention provides a method of separating labile metal species and non-labile metal species present in an aqueous acidic phase. The nature of the labile and non-labile metal species separated according to the present invention is not particularly limited. As explained above, the inventors' realisation underlying this invention is generally applicable to the separation of labile and non-labile metal species. The metals may be transition metals, for example.

However, the present inventors consider that the methods of the present invention are particularly applicable to the separation of precious metal species. As used herein, the term precious metals is intended to refer to gold, silver and the platinum group metals. The platinum group metals are platinum, palladium, ruthenium, rhodium, osmium and iridium. The methods of the present invention are particularly suitable for the separation of platinum group metal species. Accordingly, the labile metal species may be a platinum group metal species. The non-labile metal species may be a platinum group metal species.

For example, the labile metal may be one or more selected from Pd(II) and Au(III), such as Pd(II). The non-labile metal may be one or more selected from Pt(IV), Pt(II), Ir(IV), Ir(III), Os(IV), Ru(IV), Ru(III) and Rh(III). For example, the non-labile metal may be one or more selected from Pt(IV), Ir(IV), Os(IV) and Ru(IV). For example, the labile metal may be Pd(II) and the non-labile metal may be one or more selected from Pt(IV), Ir(IV), Os(IV) and Ru(IV).

There is a particular need for improved methods for the separation of platinum and palladium, and the present invention is suitable for the separation of these metals. Accordingly, the labile metal species may be a palladium species (e.g. in the II oxidation state), and/or the non-labile metal species may be a platinum species (e.g. in the IV oxidation state). For example, the methods of the present invention may be used to separate Pt(IV) from Pd(II). The methods of the present invention may be used to separate Pt(IV) from Pd(II) in the presence of Ru(III) and/or Rh(III).

The methods of the present invention may be used to separate Ir(IV) from Au(III).

The extractants used in the present invention may selectively extract the labile and non-labile metal species from the aqueous acidic phase in the presence of additional metal species which are not significantly extracted into the organic phase. For example, the distribution coefficient for each additional metal species may be preferably 0.1 or less, 0.01 or less or 0.001 or less. It may be zero, or at least 0.0001, for example. Typically, the distribution coefficient of the labile metal and the non-labile metal will be considerably higher than this. For example, the distribution coefficient for extraction of the non-labile metal species into the organic phase is typically at least 2, at least 5, at least 10, at least 20, at least 30, at least 40 or at least 50 and may be considerably higher than this. The upper limit tends to infinity as substantially all of the metal is extracted. Similarly, the distribution coefficient for extraction of the labile metal species into the organic phase is typically at least 2, at least 5, at least 10, at least 20, at least 30, at least 40 or at least 50 and may be considerably higher than this. The upper limit tends to infinity as substantially all of the metal is extracted. (As the skilled person will understand, the distribution coefficient ($D_A^{\backslash O}$) is the concentration of the relevant metal species in the organic phase divided by the concentration of that metal species in the aqueous acidic phase.)

The skilled person is aware of suitable coordinating extractants and suitable outer sphere extractants for selectively extracting particular metal species in the presence of additional metal species. The choice of extractants depends on the nature of the metals to be separated, and in particular the relative lability of (i) the labile metal species, (ii) the non-labile metal species and (iii) any additional metal species present. For example, EP 0 210 004 describes mono-N-substituted amide extractants suitable for selectively extracting platinum, iridium and osmium species having an oxidation state of IV, gold of an oxidation state of III, and ruthenium having whatever oxidation state it has in the compound ruthenium nitrosyl chloride, $[RuCl_5NO]^{2-}$. However, the selectivity of the extractant depends on the oxidation state of the metal to be extracted, and the oxidation state of the additional metals in the aqueous acidic phase. For example, EP 0 210 004 explains that, using its mono-N-substituted amide extractants,

- platinum of oxidation state IV may be extracted in preference to palladium of oxidation state II;
- iridium of oxidation state IV may be extracted in preference to rhodium of oxidation state III; and
- platinum of oxidation state IV may be extracted in preference to ruthenium, iridium and osmium species of oxidation state III (although Os(III) is typically unstable in the presence of air).

Accordingly, it can be seen that the selectivity of a particular extractant may depend on the oxidation states of the metal(s) to be extracted, and of the metal(s) which are to be left in the aqueous acidic phase. The skilled person is aware of suitable techniques for adjusting the oxidation state of the metal species in the aqueous acidic phase. For example, EP 0 210 004 explains that it is usual to treat an aqueous acidic solution with a mild reducing agent which largely does not affect the platinum species but which ensures that iridium, osmium and ruthenium species are present in an oxidation state of III. Suitable mild reducing agents include acetone or methyl isobutylketone.

The methods of the present invention are particularly suitable where the labile metal is Pd(II), the non-labile metal is a platinum group metal (other than Pd) in oxidation state IV, wherein one or more additional metal species are present in the aqueous acidic phase. Particularly suitable additional metal species are platinum group metals in oxidation state II or III (preferably III), and base metals (e.g. in oxidation state II or III). The additional metal species is typically a species which is substantially not extracted by the outer sphere extractant employed and which is substantially not extracted by the coordinating extractant employed. As discussed above, the skilled person is aware of suitable coordinating extractants and suitable outer sphere extractants for selectively extracting particular metal species in the presence of additional metal species.

In a particularly preferred embodiment, the labile metal species is a palladium species (e.g. in oxidation state II) the non-labile metal species is a platinum species (e.g. in oxidation state IV), and the platinum and palladium species are selectively extracted from an aqueous acidic phase which also includes one or more additional precious metal species, e.g. one or more additional platinum group metal species. The additional precious metal species may be in oxidation state III. The additional precious metal species may be one or more selected from iridium, ruthenium and rhodium species.

The labile metal species may be a chloro complex. The non-labile metal species may be a chloro complex.

Aqueous Acidic Phase

The aqueous acidic phase is the phase from which the metal species are extracted using the extractants in the methods of the present invention.

Typically, the $H^+$ concentration of the aqueous acidic phase is at least 3 mol $dm^{-3}$ or at least 4 mol $dm^{-3}$. Typically, the $H^+$ concentration of the aqueous acidic phase is 10 mol $dm^{-3}$ or less, 9 mol $dm^{-3}$ or less or 8 mol $dm^{-3}$ or less. As the skilled person will understand, the acidity used will depend on the metal species to be separated and on the extractants employed. A particularly preferred $H^+$ concentration is in the range from 4 to 8 mol $dm^{-3}$, more preferably 5 to 7 mol $dm^{-3}$, or 5.5 to 6.5 mol $dm^{-3}$. This is particularly suitable for the separation of Pt(IV) and Pd(II).

The aqueous acidic phase typically comprises HCl. Typically, the HCl concentration of the aqueous acidic phase is at least 3 mol $dm^{-3}$ or at least 4 mol $dm^{-3}$. Typically, the HCl concentration of the aqueous acidic phase is 10 mol $dm^{-3}$ or less, 9 mol $dm^{-3}$ or less or 8 mol $dm^{-3}$ or less. A particularly preferred HCl concentration is in the range from 4 to 8 mol $dm^{-3}$, more preferably 5 to 7 mol $dm^{-3}$, or 5.5 to 6.5 mol $dm^{-3}$. This is particularly suitable for the separation of Pt(IV) and Pd(II).

Other suitable acids include sulphuric acid, perchloric acid and nitric acid, which are preferably present at a suitable concentration to give the $H^+$ concentrations specified above.

Typically the labile metal species and the non-labile metal species are each present in the aqueous acidic phase at a concentration of about 150 g $L^{-1}$ or less, 120 g $L^{-1}$ or less, 110 g $L^{-1}$ or less, 100 g $L^{-1}$ or less, 70 g $L^{-1}$ or less, 50 g $L^{-1}$ or less, 25 g $L^{-1}$ or less or 10 g or less. They may be present at a concentration of at least 0.1 g $L^{-1}$, at least 0.5 g $L^{-1}$, at least 1 g $L^{-1}$ or at least 5 g $L^{-1}$. The concentrations are with respect to the mass of metal in the metal species.

Any additional metal species present in the aqueous acidic phase (which are typically substantially not extracted into the organic phase) may for example each be present at a concentration of at least 0.05 g $L^{-1}$, at least 0.1 g $L^{-1}$ or at least 0.5 g $L^{-1}$. Each additional metal species may for example be present at a concentration of 100 g $L^{-1}$ or less, 50 g $L^{-1}$ or less, 55 g $L^{-1}$ or less, 10 g $L^{-1}$ or less, 5 g $L^{-1}$ or less, or 1 g $L^{-1}$ or less. The concentrations are with respect to the mass of metal in the metal species.

Organic Phase and Extractants

Extractants are compounds employed in extracting metals from the aqueous acidic phase into an organic phase. Accordingly, extractants are typically substantially insoluble in the aqueous acidic phase and soluble in the organic phase.

The nature of the outer sphere extractant is not particularly limited. A range of different outer sphere extractants can be employed in the methods of the present invention, as demonstrated in the Examples below.

Without wishing to be bound by theory, the present inventors believe that some types of outer sphere extractants become protonated due to the acidity of the aqueous acidic phase, facilitating their outer sphere interaction with the non-labile metal species (which is typically a negatively charged complex ion). Accordingly, it is preferable that the outer sphere extractant includes a protonatable moiety.

As discussed in Reference 2, outer sphere extractants ("anion exchangers") can be categorised as strong-base and weak-base extractants. Strong base extractants include extractants which are readily protonated even in weak acid (e.g. weak hydrochloric acid), and typically require alkali treatment to deprotonate them (e.g. with hydroxide). Weak base extractants typically require contact with strong acid (e.g. hydrochloric acid) to become protonated, but are readily deprotonated on contact with water or a weak acid. This is discussed in Reference 2, which is hereby incorporated by reference in its entirety and particularly for the purposes of describing the behaviour of outer sphere extractants.

In the methods of the present invention, when the non-labile metal species is stripped from the organic phase into the first aqueous solution, typically water or a weak acid are employed. The water or weak acid is believed to deprotonate the outer sphere extractant, thus disrupting its interaction with the non-labile metal species in the organic phase. The non-labile metal species is therefore transferred from the organic phase to the water or weak acid. Accordingly, preferably the outer sphere extractant is a weak base extractant. The skilled person readily understands this term and is able to determine whether a given extractant is a weak base extractant. As the skilled person will understand, typically a weak base extractant includes a protonatable moiety that is readily protonated on contact with a strong acid (e.g. on contact with a solution having an HCl concentration of 3 mol $dm^{-3}$ or more). Typically, the protonatable moiety is readily deprotonated on contact with water or an acidic solution having an HCl concentration of 1 mol $dm^{-3}$ or less, e.g. 0.5 mol $dm^{-3}$ or less.

Suitable protonatable moieties include, for example, an amide moiety, and a P═O moiety. Particularly suitable outer sphere extractants are specified in Table 1 below. It may be preferred that the outer sphere extractant does not include an amine moiety.

The outer sphere extractant may include an amide moiety. The amide may be a primary, secondary or tertiary amide. More preferable are secondary or tertiary amide moieties. In some embodiments, a secondary amide moiety is most preferable. For example, the outer sphere extractant may be a compound according to Formula I below:

Formula I

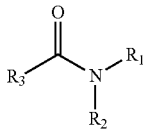

wherein $R_1$ and $R_2$ are independently selected from H or an optionally substituted $C_1$-$C_{20}$ hydrocarbon moiety; and $R_3$ is an optionally substituted $C_1$-$C_{20}$ hydrocarbon moiety.

Preferably, $R_1$ and $R_2$ are independently selected from H or an optionally substituted $C_3$-$C_{20}$ hydrocarbon moiety and $R_3$ is an optionally substituted $C_1$-$C_{20}$ hydrocarbon moiety.

It may be preferable that at least one of $R_1$ and $R_2$ is H. It may be preferable that at least one of $R_1$ and $R_2$ is an optionally substituted $C_3$-$C_{20}$ hydrocarbon moiety. It may be preferable that $R_1$ and $R_2$ are independently selected from H or an optionally substituted $C_5$-$C_{20}$ hydrocarbon moiety. It may be preferable that $R_1$ and $R_2$ are independently selected from H or an optionally substituted $C_5$-$C_{15}$ hydrocarbon moiety.

It may be preferable that $R_3$ is an optionally substituted $C_1$-$C_{15}$ hydrocarbon moiety.

It may be preferable that the total number of carbon atoms in $R_1$, $R_2$ and $R_3$ taken together is at least 10, at least 15 or at least 16.

In a preferred embodiment:

$R_1$ is optionally substituted $C_8$-$C_{18}$ alkyl;

$R_2$ is H; and $R_3$ is optionally substituted $C_8$-$C_{18}$ alkyl.

In a preferred embodiment:

$R_1$ is optionally substituted $C_{10}$-$C_{15}$ alkyl;

$R_2$ is H; and $R_3$ is optionally substituted $C_{10}$-$C_{15}$ alkyl.

In a preferred embodiment:

$R_1$ is optionally substituted $C_3$-$C_{15}$ alkyl;

$R_2$ is optionally substituted $C_3$-$C_{15}$ alkyl; and $R_3$ is optionally substituted $C_1$-$C_5$ alkyl, optionally wherein total number of carbon atoms in $R_1$, $R_2$ and $R_3$ taken together is at least 10, or at least 15.

In a preferred embodiment:

$R_1$ is optionally substituted $C_5$-$C_{10}$ alkyl;

$R_2$ is optionally substituted $C_5$-$C_{10}$ alkyl; and $R_3$ is optionally substituted $C_1$-$C_4$ alkyl, optionally wherein total number of carbon atoms in $R_1$, $R_2$ and $R_3$ taken together is at least 11, at least 12 or at least 15.

It may be preferable that one or more, e.g. each, of $R_1$, $R_2$ and $R_3$ are unsubstituted.

The outer sphere extractant may include a P═O moiety. For example, the outer sphere extractant may include an organic phosphate, phosphonate or phosphinate (e.g. alkyl phosphate, alkyl phosphonate or alkyl phosphinate) or an organic phosphine oxide (e.g. alkyl phosphine oxide) moiety.

For example, the outer sphere extractant may be a compound according to Formula II below:

Formula II

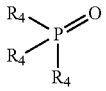

wherein each $R_4$ is independently selected from an optionally substituted $C_3$-$C_{20}$ hydrocarbon moiety and —$OR_5$, wherein each $R_5$ is an optionally substituted $C_2$-$C_{20}$ hydrocarbon moiety.

It may be preferable that each $R_4$ is independently an optionally substituted $C_3$-$C_{15}$ hydrocarbon moiety, e.g. an optionally substituted $C_4$-$C_{15}$ hydrocarbon moiety or an optionally substituted $C_5$-$C_{10}$ hydrocarbon moiety.

It may be preferable that each $R_4$ is independently —$OR_5$, wherein each $R_5$ is an optionally substituted $C_2$-$C_{20}$ hydrocarbon moiety, e.g. an optionally substituted $C_3$-$C_{15}$ or $C_3$-$C_{10}$ hydrocarbon moiety.

In a preferred embodiment, each $R_4$ is independently optionally substituted $C_5$-$C_{10}$ alkyl, or is —$OR_5$, wherein each $R_5$ is an optionally substituted $C_3$-$C_{10}$ alkyl. In a particularly preferred embodiment, each $R_4$ is $C_5$-$C_{10}$ alkyl.

In some embodiments, it is preferable that one or more, e.g. each $R_4$ and $R_5$ are unsubstituted.

In some embodiments, it may be preferable that the outer sphere extractant does not include an amine group.

The nature of the coordinating extractant is not particularly limited in the present invention. It includes a moiety capable of forming a covalent coordination bond with the metal atom of the labile metal species.

Preferably, the coordinating extractant includes a sulphur atom. For example, it may include one or more functional groups selected from the group consisting of thiol, thioether, thioketone, thioaldehyde, phosphine sulphide and thiophosphate. More preferably the coordinating extractant includes one or more functional groups selected from thioether and phosphine sulphide.

For example, the coordinating extractant may be a compound according to Formula III below:

Formula III

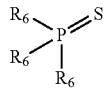

wherein each $R_6$ is independently selected from an optionally substituted $C_2$-$C_{20}$ hydrocarbon moiety and —$OR_7$, wherein each $R_7$ is an optionally substituted $C_2$-$C_{20}$ hydrocarbon moiety.

It may be preferable that each $R_6$ is independently an optionally substituted $C_2$-$C_{15}$ hydrocarbon moiety, e.g. an optionally substituted $C_2$-$C_{15}$ hydrocarbon moiety or an optionally substituted $C_3$-$C_8$ hydrocarbon moiety. For example, each $R_6$ may preferably be optionally substituted $C_2$-$C_{15}$ alkyl, or more preferably optionally substituted $C_3$-$C_8$ alkyl.

It may be preferable that each $R_6$ is independently —$OR_7$, wherein each $R_7$ is an optionally substituted $C_2$-$C_{20}$ hydrocarbon moiety, e.g. an optionally substituted $C_2$-$C_{15}$ or $C_3$-$C_8$ hydrocarbon moiety. For example, each $R_7$ may preferably be optionally substituted $C_2$-$C_{15}$ alkyl, or more preferably optionally substituted $C_3$-$C_8$ alkyl.

In some embodiments, it is preferable that one or more, e.g. each $R_6$ and $R_7$ are unsubstituted.

The coordinating extractant may be a compound according to Formula IV below:

Formula IV

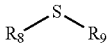

wherein $R_8$ is selected from H and an optionally substituted $C_1$-$C_{20}$ hydrocarbon moiety, and $R_9$ is an optionally substituted $C_1$-$C_{20}$ hydrocarbon moiety. $R_8$ may be selected from H and an optionally substituted $C_3$-$C_{15}$ hydrocarbon moiety, more preferably an optionally substituted $C_5$-$C_{10}$ hydrocarbon moiety. $R_9$ may be an optionally substituted $C_3$-$C_{15}$ hydrocarbon moiety, more preferably an optionally substituted $C_5$-$C_{10}$ hydrocarbon moiety. Preferably, $R_8$ is an optionally substituted hydrocarbon moiety. For example, both of $R_8$ and $R_9$ may be optionally substituted $C_3$-$C_{15}$ alkyl, more preferably optionally substituted $C_5$-$C_{10}$ alkyl. It may be preferred that the total number of carbon atoms in $R_8$ and $R_9$ taken together is at least 5, at least 6, at least 10, at least 12 or at least 16.

In some embodiments, it is preferable that $R_8$ and $R_9$ are unsubstituted.

As used herein, the term optionally substituted includes moieties in which one, two, three, four or more hydrogen atoms have been replaced with other functional groups. Suitable functional groups include —OH, —SH, —$SR_{11}$, -Hal, —$NR_{11}R_{11}$, C(O)$COR_{11}$, —OC(O)$R_{11}$, —$NR_{11}$C(O)$R_{11}$ and C(O)$NR_{11}R_{11}$, wherein each $R_{11}$ is independently H or $C_1$ to $C_{10}$ alkyl or alkenyl and wherein each -Hal is independently selected from —F, —Cl and —Br, e.g. —Cl. In the case of the outer sphere extractant, it may be preferable that the extractant does not include a sulphur atom and/or does not include an amine group. For example, suitable substituent functional groups include —OH, —$OR_{11}$, -Hal, C(O)$COR_{11}$, —OC(O)$R_{11}$, —$NR_{11}$C(O)$R_{11}$ and C(O)$NR_{11}R_{11}$, wherein each $R_{11}$ is independently H or $C_1$ to $C_{10}$ alkyl or alkenyl and wherein each -Hal is independently selected from —F, —Cl and —Br, e.g. —Cl.

As used herein, the term hydrocarbon moiety is intended to include alkyl (including cycloalkyl), alkenyl, alkynyl, aryl and alkaryl and aralkyl. The hydrocarbon moiety may be linear or branched. It is preferable that the hydrocarbon moiety is alkyl, aryl, alkaryl or aralkyl, more preferably alkyl, which may be linear or branched.

The organic phase typically includes a diluent in addition to the complexing extractant and the outer sphere extractant. A wide range of diluents are commonly used in solvent extraction processes, and the nature of the diluent is not particularly limited in the present invention. The complexing extractant and the outer sphere extractant should both be soluble in the diluent. Suitable diluents include aromatic petroleum solvents such as Solvesso 150 and Shellsol D70, or ketones such as 2,6-dimethyl-4-heptanone, but other organic solvents (such as aliphatic or aromatic hydrocarbon solvents and alcohols) are suitable. Typically, a diluent will be selected to give a convenient viscosity for processing, a high flash point and/or low volatility.

Typically, the coordinating extractant is present in the organic phase at a concentration of about 0.03 to 0.04 M. For example, the coordinating extractant may be present at a concentration of at least 0.01 M, at least 0.02 M or at least 0.03 M. There is no particular upper limit on the concentration of the coordinating extractant in the organic phase. The Examples below demonstrate that coordinating extractants may advantageously be used at low concentrations and still provide an excellent degree of extraction of the labile metal species. It may be preferable that the coordinating extractant is present at a concentration of 1 M or less, 0.2 M or less, or 0.1 M or less. The concentration of the coordinating extractant is typically selected to satisfy the coordination number of the labile metal species, and so may depend on the nature and concentration of the labile metal species in the aqueous acidic phase.

Typically, the outer sphere extractant is present in the organic phase at a concentration between 0.5 M and 2.5 M. For example, the outer sphere extractant may be present at a concentration of at least 0.1 M, 0.2 M or 0.3 M. There is no particular upper limit on the concentration of the outer sphere extractant, but it may be preferred that the outer sphere extractant is present in the organic phase at a concentration of 5 M or less, 3 M or less, or 1 M or less.

In some embodiments, particularly but not exclusively wherein the outer sphere extractant is a compound according to Formula II, (e.g. wherein each $R_4$ is independently —$OR_5$), it may be preferred that the outer sphere extractant is present at a concentration of at least 1 M, at least 1.2 M or at least 1.5 M. This may be preferable, for example, where the outer sphere extractant is tributyl phosphate.

The organic phase may also include solvent extraction modifiers, which can be employed for example to alter (e.g. lower) the viscosity of the organic phase, to enhance separation of the organic phase from the aqueous phase, and/or to suppress phase separation within the organic phase. The skilled person will be aware of suitable solvent extraction modifiers, which include for example alcohols, phenols or organic phosphates such as tributyl phosphate. Any solvent extraction modifiers are typically each present in the organic phase at a concentration of 0.9 M or less, preferably 0.7 M or less.

(As the skilled person will readily appreciate, the features of the organic phase discussed herein are equally applicable to the solvent extraction mixture of the second, third and fourth aspects of the invention.)

Separation Process

In step (a) of the methods of the present invention, the aqueous acidic phase is contacted with the organic phase, to extract the labile and non-labile metals into the organic phase. Typically, substantially all of the labile metal present in the aqueous acidic phase is extracted into the organic phase. For example, at least 95%, at least 99% or at least 99.5% is extracted. In some embodiments, a slightly lower proportion of non-labile metal is extracted into the organic phase. For example, at least 90%, at least 95%, at least 97% or at least 98% is extracted. The degree of extraction can be increased, for example by increasing the contact time and/or the number of contacts between the aqueous acidic phase and the organic phase, or by adjusting the acidity of the aqueous acidic feed as demonstrated in more detail below. One, two, three or more extraction steps may be included.

Following the extraction step, the organic phase may optionally be scrubbed. Typically, this is done by contacting the organic phase (after it has been contacted with the aqueous acidic phase) with an aqueous scrubbing solution, which preferably has a similar (e.g. the same) acidity as the aqueous acidic phase. Typically, the $H^+$ concentration of the aqueous scrubbing solution is within 1 M of the $H^+$ concentration of the aqueous acidic phase, more preferably within 0.5 M. Scrubbing advantageously allows any additional metals inadvertently extracted into the organic phase to be removed from the organic phase before the stripping step (step (b)). One, two, three or more scrubbing steps may be included. The scrubbing step may also help to remove entrained liquid from the organic phase. The scrubbing solution may comprise HCl.

In the selective stripping step of the present invention, the non-labile metal species is selectively stripped from the organic phase using water or an acidic aqueous stripping solution, to provide a first aqueous solution comprising non-labile metal species. Typically, the first aqueous solution includes substantially none of the labile metal species. For example, it may include 10 mg $L^{-1}$ or less, 5 mg $L^{-1}$ or less, or 2 mg $L^{-1}$ or less of the labile metal species. The first aqueous solution may include 10 mg $L^{-1}$ or less, 5 mg $L^{-1}$ or less, or 2 mg $L^{-1}$ or less of additional metal species. The concentrations are with respect to the mass of metal in the metal species.

Typically, the acidic aqueous stripping solution is less acidic than the aqueous acidic phase from which the labile and non-labile metal species are extracted. For example, the acidic aqueous stripping solution may have an $H^+$ concentration which is at least 1 M lower than the $H^+$ concentration of the aqueous acidic phase. For example, the $H^+$ concentration of the acidic aqueous stripping solution may typically be 4 M or less, 3 M or less, or 2 M or less. As demonstrated in the Examples, an $H^+$ concentration of about 1 M or 0.1 M may be particularly suitable. The stripping solution may comprise HCl.

Whether water or an acidic aqueous acidic phase is used to selectively strip the non-labile metal from the organic phase, it will typically have a pH of 7 or less. One, two, three or more stripping operations may be carried out, in order to maximise recovery of the non-labile metal.

Following the stripping step, the organic phase may optionally be washed with water. This can avoid transfer of any entrained acid from the organic phase into the solution used for selective stripping of the labile metal species. The water used for the wash may optionally be combined with the first aqueous solution, to maximise recovery of the non-labile metal.

In the selective stripping step of the present invention, the labile metal species is selectively stripped from the organic phase using an aqueous phase comprising a complexing reagent capable of complexing with the labile metal, to provide a second aqueous solution comprising labile metal species.

The complexing reagent includes a moiety capable of forming a covalent coordination bond with the metal atom of the labile metal species. Accordingly, it will be understood that the complexing reagent typically includes an atom having a lone pair capable of forming a covalent coordination bond with the metal atom of the labile metal species. For example, the moiety may comprise a nitrogen atom capable of forming a covalent coordination bond with the metal atom of the labile metal species. The moiety may comprise a sulphur atom capable of forming a covalent coordination bond with the metal atom of the labile metal species. The moiety may comprise an oxygen atom capable of forming a covalent coordination bond with the metal atom of the labile metal species. The moiety may comprise a phosphorus atom capable of forming a covalent coordination bond with the metal atom of the labile metal species. Particularly suitable complexing reagents include ammonia, compounds comprising an amine moiety (e.g. a primary or secondary amine), compounds comprising an oxime moiety, compounds comprising a —C═S moiety, compounds comprising a —S═O moiety and compounds comprising a —C═O moiety, and in particular include ammonia, compounds comprising an oxime moiety, compounds comprising a —C═S moiety, and compounds comprising a —S═O moiety. For example, the complexing reagent may be ammonia, an oxime (e.g. acetaldehyde oxime), a sulphite (e.g. ammonium sulphite) or thiourea.

The complexing reagent is water soluble, in order that it is capable of drawing the labile metal species into the second aqueous solution. Typically, the complexing reagent is present in the aqueous phase at a sufficiently high concentration that the equilibrium of the stripping reaction favours transfer of the labile metal to the aqueous phase. For example, the concentration of the complexing reagent in the aqueous phase is typically at least 1 M, at least 2 M or at least 3 M. A particularly suitable concentration is in the range from 3 M to 9 M.

Typically, the second aqueous solution includes substantially none of the non-labile metal species. For example, it may include 10 mg $L^{-1}$ or less, 5 mg $L^{-1}$ or less, or 2 mg $L^{-1}$ or less of non-labile metal species. The second aqueous solution may include 10 mg $L^{-1}$ or less, 5 mg $L^{-1}$ or less, or 2 mg $L^{-1}$ or less of additional metal species. The concentrations are with respect to the mass of metal in the metal species.

Typically the processes of the present invention are carried out at room temperature.

EXAMPLES

The following Examples demonstrate the efficacy of the invention for the combinations of extractants indicated in Table 1 below.

TABLE 1

| Example | Coordinating Extractant | Outer Sphere Extractant |
|---|---|---|
| 1 | Di-n-octyl sulphide 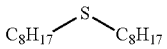 | N-(iso-tridecyl)isotridecanamide 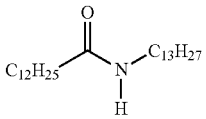 |
| 2 | Di-n-octyl sulphide 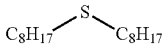 | Cyanex 923 (mixture of hexyl and octyl phosphine oxides) 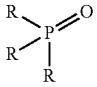 |
| 3 | Cyanex 471X (tri isobutyl phosphine sulphide) 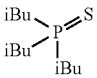 | Tributyl phosphate 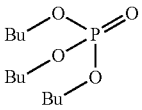 |
| 4 | Di-n-hexyl sulphide 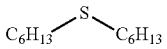 | N,N-dioctyl acetamide 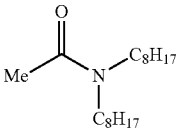 |

Example 1

Preparation of Aqueous Feedstock Solution

An aqueous feedstock containing platinum group metals was prepared with concentrations as set out in Table 2 below:

TABLE 2

| Metal | Concentration/$gL^{-1}$ |
|---|---|
| Pt(IV) | 100 |
| Pd(II) | 100 |
| Ir(III) | 5 |
| Rh(III) | 10 |
| Ru(III) | 30 |

This stock solution was diluted 100-fold for use in extraction experiments.

Preparation of Extractants

N-(iso-tridecyl))isotridecanamide was prepared by a process analogous to Example 1 of EP-B-0 210 004, which describes the synthesis of N-(n-propyl)-isohexadecamide.

(The content of EP-B-0 210 004 is incorporated herein by reference in its entirety and for all purposes, and in particular for the purpose of describing the synthesis of mono-N substituted amide extractants, and for the purposes of describing and defining extraction of precious metal species.)

Di-n-octyl sulphide (DOS) is commercially available from Alfa Aesar, A Johnson Matthey Company. Its CAS number is 2690-08-6.

Preparation of the Organic Phase

1 L 0.5M N-(iso-tridecyl))isotridecanamide, 15% tributyl phosphate (TBP), 1% (w/v) DOS in Shellsol D70 was prepared by mixing 454 mL 50% (v/v) N-(iso-tridecyl)) isotridecanamide in Shellsol D70, 150 g TBP, 10 g DOS and was made up to volume with Shellsol D70.

Shellsol D70 is commercially available from Shell Chemicals Limited, UK.

TBP is commercially available from Alfa Aesar, A Johnson Matthey Company. Its CAS number is 126-73-8.

Pt and Pd Extraction at Different Acidities

Extraction of platinum and palladium species from feeds with different acidities The feeds were made up as set out in below, using feedstock solution prepared as described above:

4 M HCl Feed:

2 mL feedstock, 131 mL 6M HCl was made up to volume with deionised water (200 mL).

8 M HCl Feed:

2 mL feedstock and 138 mL conc. HCl were made up to volume with deionised water (200 mL).

6 M HCl Feed:

5 mL feedstock was made up to volume with 6 M HCl (500 mL).

The solvent extraction procedure for each of three feed acidities involved a single extraction of Pt and Pd from the feed into an equal volume of the organic phase by mixing for two minutes. The metal-containing organic phase was then subject to two scrub steps with equal volumes of fresh aqueous hydrochloric acid of the same concentration as the appropriate feed, again mixing for two minutes. The Pt was subsequently selectively stripped from the organic phase into an equal volume of dilute aqueous hydrochloric acid (0.1 M) by mixing for two minutes. The strip process was repeated. The organic phase was washed with an equal volume of clean water by mixing for two minutes. Pd was selectively stripped from the organic phase by mixing the organic phase with an equal volume of aqueous ammonium hydroxide (6 M).

The results for each of the aqueous solutions through the experiments at 4, 6 and 8 M HCl are provided in Tables 3, 4 and 5, respectively. The concentration of metal species was determined using Inductively Coupled Plasma Mass Spectroscopy (ICP analysis). This data shows that the extractants employed in this Example will selectively extract Pt and Pd from the other PGMs across a range of acidities. It also demonstrates that Pt may be selectively stripped from the organic phase, followed by selective stripping of Pd. The water wash could be combined with the Pt Strip solutions to maximise Pt recovery.

TABLE 3

| 4M HCl feed | Concentration of metal species: mg $L^{-1}$ | | | | |
|---|---|---|---|---|---|
| Phase | Pd | Pt | Ir | Rh | Ru |
| Feed | 1010 | 972 | 48 | 95 | 284 |
| Raffinate | — | 89 | 49 | 98 | 290 |
| Scrub 1 | — | 67 | 1 | — | 2 |
| Scrub 2 | — | 67 | — | — | 1 |
| Pt Strip 1 | — | 696 | — | — | — |
| Pt Strip 2 | — | 17 | — | — | — |
| Water Wash | — | 6 | — | — | — |
| Pd Strip | 938 | 2 | — | — | — |

Note:

"—" means less than detection limit of ICP

TABLE 4

| 6M HCl feed | Concentration of metal species: mg $L^{-1}$ | | | | |
|---|---|---|---|---|---|
| Phase | Pd | Pt | Ir | Rh | Ru |
| Feed | 1019 | 967 | 48 | 98 | 285 |
| Raffinate | — | 14 | 48 | 99 | 279 |
| Scrub 1 | — | 11 | — | 1 | 1 |
| Scrub 2 | — | 10 | — | — | — |
| Pt Strip 1 | — | 812 | — | — | 5 |
| Pt Strip 2 | — | 27 | — | — | — |
| Water Wash | — | 8 | — | — | — |
| Pd Strip | 941 | 3 | — | — | — |

Note:
"—" means less than detection limit of ICP

TABLE 5

| 8M HCl feed | Concentration of metal species: mg $L^{-1}$ | | | | |
|---|---|---|---|---|---|
| Phase | Pd | Pt | Ir | Rh | Ru |
| Feed | 1027 | 973 | 48 | 98 | 287 |
| Raffinate | 1 | 27 | 49 | 100 | 291 |
| Scrub 1 | — | 30 | 1 | 2 | 4 |
| Scrub 2 | — | 29 | — | — | 1 |
| Pt Strip 1 | — | 687 | — | — | 2 |
| Pt Strip 2 | — | 34 | — | — | — |
| Water Wash | — | 8 | — | — | — |
| Pd Strip | 959 | 7 | — | — | — |

Note:
"—" means less than detection limit of ICP

Table 6 and FIG. 1 show the distribution coefficients (calculated based on aqueous analysis), $D_A\backslash^O$, for Pt, Ir, Rh and Ru (Pd is excluded as its distribution coefficient is very large). The distribution coefficient is the concentration of the metal species in the organic phase divided by the concentration of the metal species in the aqueous phase. Concentrations in the organic phase have been calculated based on aqueous analysis. This demonstrates that maximum Pt extraction occurs at 6 M HCl. In all instances Ir, Rh and Ru extraction is very low, demonstrating selectivity for Pt and Pd.

TABLE 6

| Acid | Distribution Coefficient, $D_A\backslash^O$ | | | | |
|---|---|---|---|---|---|
| Concentration | Pt | Pd | Ir | Rh | Ru |
| 4 | 10 | >1010 | 0 | 0 | 0 |
| 6 | 69 | >1019 | 0 | 0 | 0 |
| 8 | 35 | >1027 | 0 | 0 | 0 |

Pt Stripping at Different Acidities

Organic phase and 6 M HCl feed prepared as described above were used to investigate the most suitable acidity for Pt stripping.

A volume of the fresh organic solution was mixed with an equal quantity of feed solution at 6 M HCl concentration for two minutes. The organic phase was then scrubbed twice by mixing with an equal volume of fresh aqueous 6 M HCl. The results are presented in Table 7

TABLE 7

| | Concentration of metal species: mg $L^{-1}$ | | | | |
|---|---|---|---|---|---|
| Phase | Pd | Pt | Ir | Rh | Ru |
| Feed | 1031 | 997 | 49 | 101 | 288 |
| Raffinate | — | 13 | 50 | 101 | 278 |
| Scrub 1 | — | 10 | 1 | — | 1 |
| Scrub 2 | — | 10 | — | — | 1 |
| Scrubbed organic (calc) | 1031 | 964 | — | — | 8 |

Note:
"—" means less than detection limit of ICP

The organic phase was split into portions to be subject to different Pt strip solutions: specifically water and HCl of 0.1, 0.5, 1.0 and 3.0 M concentration.

Figure 3:
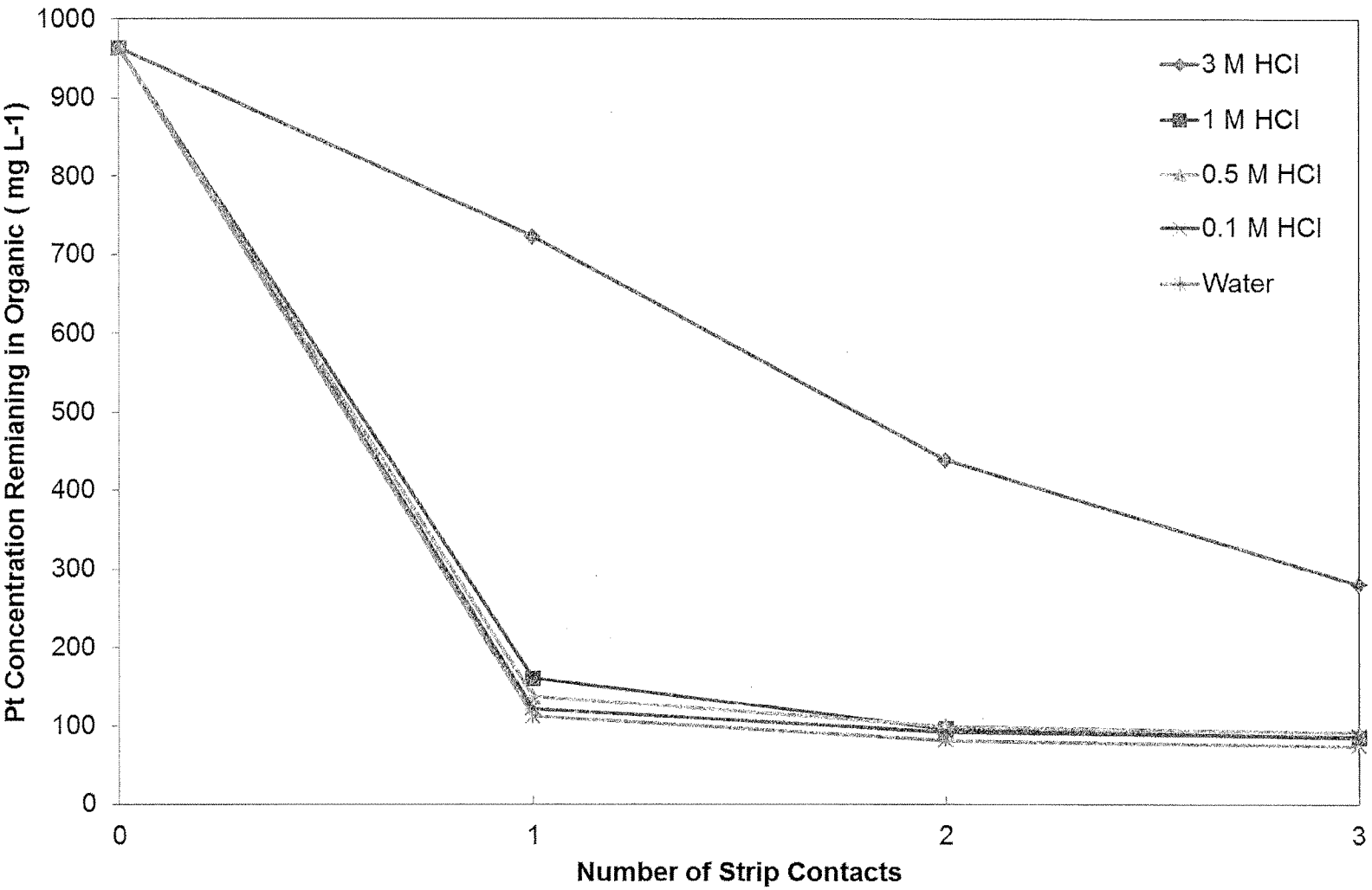
FIG. 3 shows concentrations of Pt in the organic phase vs the number of contacts with the strip solution, for different HCl concentrations of the aqueous strip solution, as determined in Example 1.

The concentration of Pt in each of the aqueous strip solutions for each of the strip conditions are tabulated in Table 8. The concentration of Pt remaining in the organic phase is shown in FIG. 3. The concentrations were determined by ICP analysis. Concentrations in the organic phase have been calculated based on aqueous analysis. This data shows that Pt stripping is most effective in the first strip at low acidity.

TABLE 8

| | Concentration of Pt in Solutions: mg $L^{-1}$ | | | | |
|---|---|---|---|---|---|
| | 3M HCl | 1M HCl | 0.5M HCl | 0.1M HCl | Water |
| Scrubbed Organic (calc) | | | 964 | | |
| 1st Aqueous Pt Strip solution | 241 | 802 | 826 | 842 | 852 |
| 2nd Aqueous Pt Strip solution | 284 | 65 | 39 | 29 | 30 |
| 3rd Aqueous Pt Strip solution | 158 | 11 | 7 | 5 | 7 |

Figure 2:
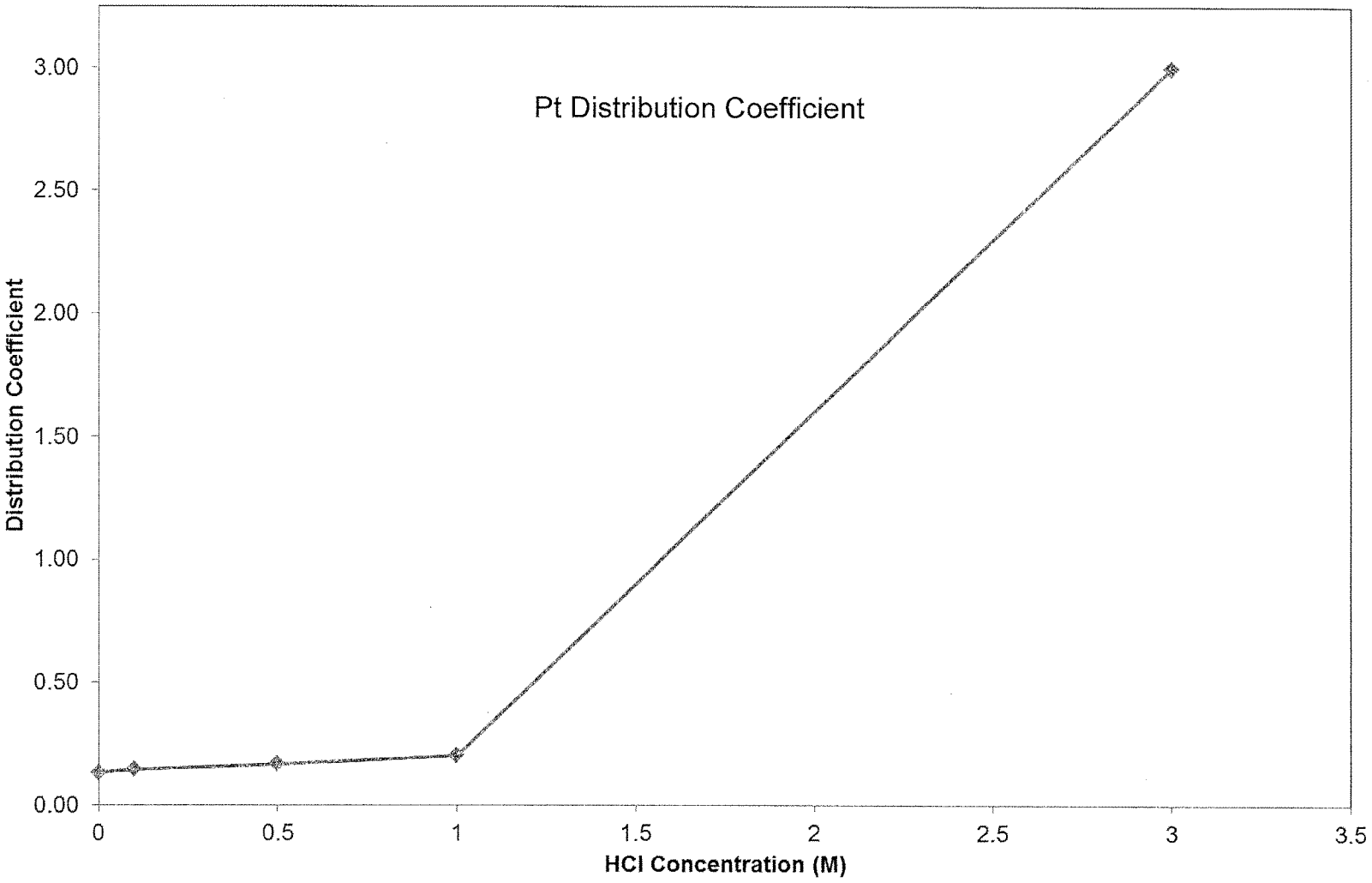
FIG. 2 shows the distribution coefficients for Pt strip from an organic phase vs HCl concentration of the aqueous strip solution, as determined in Example 1.

The distribution coefficients, $D_A\backslash^O$, for the first Pt strips into the different solutions are tabulated in Table 9 and shown in FIG. 2. This data highlights that the best stripping (lowest $D_A\backslash^O$) occurs under low acidities.

TABLE 9

| Acidity | $D_A\backslash^O$ |
|---|---|
| 3M HCl | 3.00 |
| 1M HCl | 0.20 |
| 0.5M HCl | 0.17 |
| 0.1M HCl | 0.14 |
| 0 (water) | 0.13 |

The distribution coefficients were highest at 3 M HCl (3.00) indicating very poor stripping, whilst that into water was lowest (0.13) indicating good stripping. The distribution coefficients at 0, 0.1, 0.5 and 1.0 M HCl were very similar.

Example 2

Preparation of the Organic Phase 25 g Cyanex 923 was weighed into a 100 mL volumetric flask and ~50 mL Solvesso 150 added and mixed. 1 g DOS was added to the mixture and made up to 100 mL final volume with Solvesso 150.

Di-n-octyl sulphide (DOS) is commercially available from Alfa Aesar, A Johnson Matthey Company. Its CAS number is 2690-08-6.

Cyanex 923 is commercially available from Cytec. It is a mixture of hexyl and octyl phosphine oxides.

Solvesso 150 is commercially available from Brenntag. Its CAS number is 64742-94-5

Solvent Extraction Process

A feed was prepared by 100-fold dilution of an aqueous feedstock solution described in Example 1 with reference to Table 2.

The solvent extraction procedure involved a single extraction of Pt and Pd from the feed into an equal volume of the organic phase by mixing for two minutes. The metal-containing organic phase was then subject to two scrub steps with equal volumes of fresh aqueous hydrochloric acid of the same concentration as the feed (6 M HCl), again mixing for two minutes. The Pt was subsequently selectively stripped from the organic phase into an equal volume of dilute aqueous hydrochloric acid (0.1 M) by mixing for two minutes. The strip process was repeated. The organic phase was washed with an equal volume of clean water by mixing for two minutes. Pd was selectively stripped from the organic phase by mixing the organic phase with an equal volume of aqueous ammonium hydroxide (6 M). A third phase was encountered during the solvent extraction process.

The results of ICP analyses during the solvent extraction process are shown in Table 10 below.

TABLE 10

| | Concentration of metal species: mg $L^{-1}$ | | | | |
|---|---|---|---|---|---|
| | Ir | Pd | Pt | Rh | Ru |
| Feed | 48 | 1042 | 983 | 100 | 286 |
| Raffinate | 47 | — | 4 | 100 | 259 |
| Scrub 1 | — | — | 2 | — | — |
| Scrub 2 | — | — | 1 | — | — |
| 0.1M HCl | — | — | 1 | — | 1 |
| 0.1M HCl | — | — | 20 | — | 5 |
| Water | 1 | — | 795 | — | 6 |
| 6M $NH_3$ | — | 505 | 11 | — | 5 |

Note:
"—" means less than detection limit of ICP

The Pt did not strip into low acid but into the water wash, indicating that either water or a very low acid concentration is required to effect the strip. This is believed to be due to the nature of the outer sphere extractant (Cyanex 923). The results show that it is preferable that this system is stripped directly into water rather than low acid. Pd stripping was not complete, but without wishing to be bound by theory, the inventors believe that this may be a result of excess Pt remaining in the organic after just one strip into water, as the Pt was not fully stripped by the single strip into water.

The results demonstrate that a mixture of Cyanex 923 and DOS will extract both Pt and Pd, and that the extracted Pt and Pd may be selectively stripped from the organic phase.

Example 3

Preparation of the Organic Phase 50 g tributyl phosphate and 1 g Cyanex 471X solid were weighted into a 100 mL volumetric flask and made up to 100 mL volume with Solvesso 150.

Tributyl phosphate (TBP) is commercially available from Alfa Aesar, A Johnson Matthey Company. Its CAS number is 126-73-8.

Cyanex 471X is commercially available from Cytec.

Solvesso 150 is commercially available from Brenntag. Its CAS number is 64742-94-5

Solvent Extraction Process

A solvent extraction process was carried out using the procedure described in Example 2 above, using an organic phase comprising TBP and Cyanex 471X prepared as described above. The results of ICP analyses during the solvent extraction process are shown in Table 11 below.

TABLE 11

| | Concentration of metal species: mg $L^{-1}$ | | | | |
|---|---|---|---|---|---|
| | Ir | Pd | Pt | Rh | Ru |
| Feed | 49 | 1048 | 958 | 101 | 288 |
| Raffinate | 52 | 17 | 197 | 107 | 304 |
| Scrub 1 | 1 | 1 | 142 | — | 4 |
| Scrub 2 | — | 1 | 110 | — | 2 |
| 0.1M HCl | — | — | 478 | — | 2 |
| 0.1M HCl | — | — | 15 | — | — |
| Water | — | — | — | — | — |
| 6M $NH_3$ | — | 1041 | 1 | — | — |

Note:
"—" means less than detection limit of ICP

The results demonstrate that a mixture of TBP and Cyanex471X will extract both Pt and Pd, and that the extracted Pt and Pd may be selectively stripped from the organic phase.

Significant Pt remained in the raffinate after extraction, but this could be addressed by including multiple extraction steps. Similarly, multiple extraction steps should reduce the amount of Pd remaining in the raffinate.

Example 4

Preparation of N,N-Dioctyl-Acetamide

Chloroform (150 mL) solution of di-n-octylamine (98%, 125.2 mL, 0.41 mol) and triethylamine (29.2 mL, 0.41 mol) were stirred in a three-neck flask over ice cold water. Acetyl chloride (>99%, 29.2 mL, 0.41 mol) in chloroform (50 mL) was added dropwise via a pressure-equalising funnel over 30 mins. The thick, creamy coloured, mixture was warmed to room temperature before being stirred at reflux for 2.5 hours. The resulting golden solution was concentrated by evaporation and diluted in n-hexane, filtered and washed with deionised water (300 mL), 6 M HCl (300 mL), deionised water (300 mL) and saturated aqueous sodium carbonate solution (300 mL). The organic phase was dried over magnesium sulfate, filtered and concentrated in vacuo. Yield: 81.3 g (70%).

Preparation of the Organic Phase 14.15 g N,N-Dioctyl acetamide and 1 g di-n-hexyl sulfide (DHS) were weighed into a 100 mL volumetric flask and made up to 100 mL volume with Solvesso 150.

Di-n-hexyl sulphide is commercially available from Alfa Aesar, A Johnson Matthey Company.

Its CAS number is 6294-31-1.

Solvesso 150 is commercially available from Brenntag. Its CAS number is 64742-94-5

Solvent Extraction Process

A solvent extraction process was carried out using the procedure described in Example 2 above, using an organic phase comprising N,N-dioctyl acetamide and DHS, prepared as described above. The results of ICP analyses during the solvent extraction process are shown in Table 12 below.

TABLE 12

| | Concentration of metal species: mg $L^{-1}$ | | | | |
|---|---|---|---|---|---|
| | Ir | Pd | Pt | Rh | Ru |
| Feed | 48 | 1049 | 986 | 100 | 291 |
| Raffinate | 49 | — | 26 | 100 | 280 |
| Scrub 1 | — | — | 20 | 1 | 2 |
| Scrub 2 | — | — | 19 | — | 1 |
| 0.1M HCl | — | — | 754 | — | 10 |
| 0.1M HCl | — | — | 16 | — | — |
| Water | — | — | 5 | — | — |
| 6M $NH_3$ | — | 924 | 40 | — | — |

Note:
"—" means less than detection limit of ICP

The results demonstrate that a mixture of N,N-dioctyl acetamide and DHS will extract both Pt and Pd, and that the extracted Pt and Pd may be selectively stripped from the organic phase.

Example 5

Preparation of the Organic Phase

1 L 0.5 M N-(iso-tridecyl)isotridecanamide, 15% TBP 1% (w/v) DOS in Shellsol D70 was prepared by mixing 454 mL 50% (v/v) N-(iso-tridecyl)isotridecanamide in Shellsol D70, 150 g TBP, 10 g DOS and was made up to volume with Shellsol D70.

Preparation of the Aqueous Phase

A feed was prepared by 100-fold dilution of an aqueous feedstock solution described in Example 1 with reference to Table 2.

Solvent Extraction Process

The solvent extraction procedure involved a single extraction of Pt and Pd from the feed into an equal volume of the organic phase by mixing for two minutes. The metal-containing organic phase was then subject to two scrub steps with equal volumes of fresh aqueous hydrochloric acid of the same concentration as the appropriate feed, again mixing for two minutes. The Pt was subsequently selectively stripped from the organic phase into an equal volume of dilute aqueous hydrochloric acid by mixing for two minutes. The strip process was repeated twice. The organic phase was washed with an equal volume of clean water by mixing for two minutes. Pd was selectively stripped from the organic phase by mixing the organic phase with an equal volume of the various aqueous strip reagents detailed in Table 13

TABLE 13

| | Concentration of Pd: mg $L^{-1}$ | Percentage Pd stripped |
|---|---|---|
| Pt Stripped Organic phase (Calc) | 1041 | |
| Organic phase after contact with: | | |
| Acetaldehyde Oxime (6M) | 20 | 98 |
| Ammonium Chloride (Saturated) | 950 | 9 |
| Aqueous Ammonia (3M) | 49 | 95 |
| Aqueous Ammonia (6M) | 24 | 98 |
| Aqueous Ammonia (9M) | 33 | 97 |
| Ammonium Sulfite (6M) | 15 | 99 |
| Thiourea (Saturated) | 1 | 100 |

This demonstrates that thiourea, ammonium sulfite and aqueous ammonia are suitable coordinating reagents for stripping Pd. It is believed that ammonium chloride is unsuitable as the ammonium ion does not have a lone pair for coordinating to Pd. The present inventors believe that it is the sulfite species which is acting as the coordinating reagent in the ammonium sulfite example.

Example 6

Preparation of Aqueous Solution

An aqueous feedstock containing gold (III) and iridium (IV) was prepared in hydrochloric acid (6 M) with Au and Ir concentrations as set out in Table 14 below:

TABLE 14

| Metal | Concentration/mg$L^{-1}$ |
|---|---|
| Au(III) | 986 |
| Ir(IV) | 983 |

Preparation of the Organic Phase 100 mL 50% (w/v) tributyl phosphate (TBP), 1% (w/v) di-n-octyl sulphide (DOS) in Multisolve 150 was prepared by mixing 50 g TBP, 1 g DOS and was made up to volume with Multisolve 150.

Multisolve 150 is commercially available from Brenntag.

TBP is commercially available from Alfa Aesar, A Johnson Matthey Company. Its CAS number is 126-73-8. DOS is commercially available from Alfa Aesar, A Johnson Matthey Company. Its CAS number is 2690-08-6.

Solvent Extraction Process

The solvent extraction procedure involved a single extraction of Au and Ir from the feed into an equal volume of the organic phase by mixing for four minutes. The metal-containing organic phase was then subject to two scrub steps with equal volumes of fresh aqueous hydrochloric acid of the same concentration as the appropriate feed, again mixing for four minutes. The Ir was subsequently selectively stripped from the organic phase into an equal volume of dilute aqueous hydrochloric acid (0.1 M) by mixing for four minutes. The strip process was repeated. Au was selectively stripped from the organic phase by mixing the organic phase with an equal volume of thiourea (1 M) in hydrochloric acid (1 M). This strip step was also repeated.

The results are provided in Table 15. The concentration of metal species was determined using Inductively Coupled Plasma Mass Spectroscopy (ICP analysis). This data shows that the extractants employed in this Example will co-extract Au and Ir. It also demonstrates that Ir may be selectively stripped from the organic phase, followed by selective stripping of Au.

TABLE 15

| | Concentration of metal species: mg $L^{-1}$ | |
|---|---|---|
| Phase | Au | Ir |
| Feed | 986 | 983 |
| Raffinate | — | 135 |
| Scrub 1 | — | 92 |
| Scrub 2 | — | 80 |
| Ir Strip 1 | — | 600 |
| Ir Strip 2 | — | 13 |
| Au Strip 1 | 698 | — |
| Au Strip 2 | 180 | — |

Note:
"—" means less than detection limit of ICP

REFERENCES

1. Gu Guobang et al, "Semi-industrial Test on Co-extraction Separation of Pt and Pd by Petroleum Sulfoxides", Solvent Extraction in the Process Industries Volume 1, Proceedings of ISEC '93.

2. R. Grant; "Precious Metals Recovery and Refining"—Proc. Int. Prec. Met. Inst. 1989

The invention claimed is:

1. A method of separating labile metal species and non-labile metal species present in an aqueous acidic phase, comprising (a) contacting the aqueous acidic phase with an organic phase comprising:

(i) an outer sphere extractant capable of extracting the non-labile metal species into the organic phase; and (ii) a coordinating extractant capable of coordinating with the labile metal atom of the labile metal species, whereby the labile and non-labile metals are extracted into the organic phase, then (b) selectively stripping the metals from the organic phase by contacting the organic phase with water or an acidic aqueous solution to provide a first aqueous solution comprising non-labile metal species, and contacting the organic phase with an aqueous phase comprising a complexing reagent capable of complexing with the labile metal atom of the labile metal species to provide a second aqueous solution comprising labile metal species.

2. A method according to claim 1, wherein the non-labile metal species is a platinum group metal species.

3. A method according to claim 1, wherein the labile metal species is selected from a platinum group metal species and a gold species.

4. A method according to claim 1 wherein the labile metal species is a palladium species, and the non-labile metal species is a platinum species.

5. A method according to claim 1 wherein the coordinating extractant includes a sulphur atom.

6. A method according to claim 5 wherein the coordinating extractant includes one or more functional groups selected from the group consisting of thioether, thioketone, thioaldehyde, phosphine sulphide and thiophosphate.

7. A method according to claim 6 wherein the coordinating extractant is:

(a) a compound according to Formula III below:

Formula III

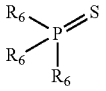

wherein each $R_6$ is independently selected from an optionally substituted $C_2$-$C_{20}$ hydrocarbon moiety and —$OR_7$, wherein each $R_7$ is an optionally substituted $C_2$-$C_{20}$ hydrocarbon moiety; or (b) a compound according to Formula IV below:

Formula IV

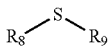

wherein $R_8$ is selected from H and an optionally substituted $C_2$-$C_{20}$ hydrocarbon moiety, and $R_9$ is an optionally substituted $C_2$-$C_{20}$ hydrocarbon moiety.

8. A method according to claim 7 wherein the coordinating extractant is a compound according to Formula III, and wherein each $R_6$ is optionally substituted $C_2$-$C_{15}$ alkyl, or each $R_6$ is —$OR_7$, wherein each $R_7$ is optionally substituted $C_2$-$C_{15}$ alkyl.

9. A method according to claim 7 wherein the coordinating extractant is a compound according to Formula IV, and wherein each of $R_8$ and $R_9$ is optionally substituted $C_3$-$C_{15}$ alkyl.

10. A method according to claim 1, wherein the outer sphere extractant includes a moiety selected from the group consisting of an amide moiety, an organic phosphate, phosphonate or phosphinate moiety or an organic phosphine oxide moiety.

11. A method according to claim 10 wherein the outer sphere extractant is a) a compound according to Formula I below:

Formula I

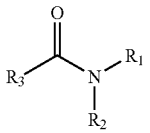

wherein $R_1$ and $R_2$ are independently selected from H or an optionally substituted $C_1$-$C_{20}$ hydrocarbon moiety; and $R_3$ is an optionally substituted C1-C20 hydrocarbon moiety; or (b) a compound according to Formula II below:

Formula II

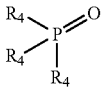

wherein each $R_4$ is independently selected from an optionally substituted $C_{3-20}$ hydrocarbon moiety and —$OR_5$, wherein each $R_5$ is an optionally substituted $C_2$-$C_{20}$ hydrocarbon moiety.

12. A method according to claim 11 wherein the outer sphere extractant is a compound according to Formula I, and wherein:

$R_1$ is optionally substituted $C_{10}$-$C_{15}$ alkyl;

$R_2$ is H; and $R_3$ is optionally substituted $C_{10}$-$C_{15}$ alkyl;

or $R_1$ is optionally substituted $C_5$-$C_{10}$ alkyl;

$R_2$ is optionally substituted $C_5$-$C_{10}$ alkyl; and $R_3$ is optionally substituted $C_1$-$C_4$ alkyl.

13. A method according to claim 11 wherein the outer sphere extractant is a compound according to Formula II and each $R_4$ is independently optionally substituted $C_5$-$C_{10}$ alkyl, or is —$OR_5$, wherein each $R_5$ is an optionally substituted $C_3$-$C_{10}$ alkyl.

14. A method according to claim 1 wherein the complexing reagent is selected from the group consisting of ammonia, compounds comprising an amine moiety (e.g. a primary or secondary amine), compounds comprising an oxime moiety, compounds comprising a —C═S moiety, compounds comprising a —S═O moiety and compounds comprising a —C═O moiety.

15. A method according to claim 1 wherein the aqueous acidic phase has an $H^+$ concentration is in the range from 4 to 8 mol $dm^{-3}$.

16. A method according to claim 2, wherein the labile metal species is selected from a platinum group metal species and a gold species.

* * * * *